US010878988B2

(12) United States Patent
Kim et al.

(10) Patent No.: US 10,878,988 B2
(45) Date of Patent: Dec. 29, 2020

(54) METHOD OF MANUFACTURING A COIL ELECTRONIC COMPONENT

(71) Applicant: SAMSUNG ELECTRO-MECHANICS CO., LTD., Suwon-si (KR)

(72) Inventors: Hyung Ho Kim, Suwon-si (KR); Yong Suk Kim, Suwon-si (KR); Gun Se Chang, Suwon-si (KR); Young Seuck Yoo, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/580,693

(22) Filed: Sep. 24, 2019

(65) Prior Publication Data

US 2020/0020475 A1 Jan. 16, 2020

Related U.S. Application Data

(62) Division of application No. 15/391,228, filed on Dec. 27, 2016, now abandoned.

(30) Foreign Application Priority Data

Apr. 15, 2016 (KR) ..... 10-2016-0046210

(51) Int. Cl.
*H01F 7/06* (2006.01)
*H01F 27/255* (2006.01)
(Continued)

(52) U.S. Cl.
CPC ..... *H01F 27/255* (2013.01); *H01F 17/04* (2013.01); *H01F 27/245* (2013.01);
(Continued)

(58) Field of Classification Search
CPC ..... H01F 41/0233; H01F 41/0246; H01F 21/061; H01F 21/076; H01F 27/263;
(Continued)

(56) References Cited

U.S. PATENT DOCUMENTS 5,912,609 A * 6/1999 Usui ..... H01F 27/292 336/192
6,114,932 A * 9/2000 Wester ..... H01F 17/0006 336/192
(Continued)

FOREIGN PATENT DOCUMENTS

JP 3381531 B2 3/2003
JP 2003-217941 A 7/2003
(Continued)

OTHER PUBLICATIONS

Notice of Office Action issued in corresponding Japanese Patent Application No. 2016-251104 dated Oct. 3, 2017, with full English translation.
(Continued)

*Primary Examiner* — Paul D Kim
(74) *Attorney, Agent, or Firm* — Morgan, Lewis & Bockius LLP

(57) ABSTRACT

A coil electronic component includes a body and external terminals. The body includes a winding coil part and a pillar-shaped core part inserted inside of the winding coil part and formed of a magnetic metal. The external terminals are connected to the winding coil part and disposed on an external surface of the body. The body contains the magnetic metal and a resin, and the pillar-shaped core part has magnetic permeability higher than that of a portion of the body disposed outside of the winding coil part.

11 Claims, 10 Drawing Sheets

(51) Int. Cl.

| | |
|---|---|
| ***H01F 27/26*** | (2006.01) |
| ***H01F 27/245*** | (2006.01) |
| ***H01F 17/04*** | (2006.01) |
| ***H01F 41/061*** | (2016.01) |
| ***H01F 41/076*** | (2016.01) |
| ***H01F 27/28*** | (2006.01) |
| ***H01F 27/29*** | (2006.01) |
| ***H01F 41/02*** | (2006.01) |
| *H01F 3/10* | (2006.01) |

(52) U.S. Cl.
CPC ..... *H01F 27/263* (2013.01); *H01F 27/2828* (2013.01); *H01F 27/292* (2013.01); *H01F 41/0233* (2013.01); *H01F 41/0246* (2013.01); *H01F 41/061* (2016.01); *H01F 41/076* (2016.01); *H01F 2003/106* (2013.01); *H01F 2017/046* (2013.01); *H01F 2017/048* (2013.01)

(58) Field of Classification Search
CPC .. H01F 27/245; H01F 27/255; H01F 27/2828; H01F 27/295; H01F 2003/106; H01F 2017/046; H01F 2017/048
See application file for complete search history.

(56) References Cited

U.S. PATENT DOCUMENTS

| | | | | |
|---|---|---|---|---|
| 6,504,463 | B1 * | 1/2003 | Kato | H01F 27/292 336/83 |
| 6,617,948 | B2 * | 9/2003 | Kuroshima | H01F 17/043 29/602.1 |
| 6,922,130 | B2 * | 7/2005 | Okamoto | H01F 27/027 336/192 |
| 7,327,212 | B2 * | 2/2008 | Sano | H01F 27/027 336/192 |
| 7,523,542 | B2 * | 4/2009 | Kawarai | H01F 17/043 29/602.1 |
| 7,915,987 | B2 | 3/2011 | Qu | |
| 8,836,459 | B1 * | 9/2014 | Hsu | H01F 27/022 336/192 |
| 10,438,737 | B2 * | 10/2019 | Sakamoto | H01F 41/04 |
| 10,446,313 | B2 * | 10/2019 | Kawarai | H01F 27/00 |
| 2003/0184423 | A1 | 10/2003 | Holdahl et al. | |
| 2003/0218527 | A1 | 11/2003 | Okamoto | |
| 2006/0038651 | A1 | 2/2006 | Mizushima et al. | |
| 2008/0078474 | A1 | 4/2008 | Naito et al. | |
| 2012/0119869 | A1 | 5/2012 | Yamamoto | |
| 2012/0218066 | A1 | 8/2012 | Inaba et al. | |
| 2014/0050001 | A1 | 2/2014 | Inaba | |
| 2014/0293655 | A1 | 10/2014 | Inaba | |
| 2017/0110233 | A1 | 4/2017 | Sakai et al. | |

FOREIGN PATENT DOCUMENTS

| | | | |
|---|---|---|---|
| JP | 2011-165977 | A | 8/2011 |
| JP | 2012-134329 | A | 7/2012 |
| JP | 2013-106004 | A | 5/2013 |
| JP | 2013-254809 | A | 12/2013 |
| JP | 2014-063923 | A | 4/2014 |
| JP | 2015-185673 | A | 10/2015 |
| JP | 2015-228411 | A | 12/2015 |
| KR | 10-2014-0063032 | A | 5/2014 |
| KR | 10-2014-0131418 | A | 11/2014 |

OTHER PUBLICATIONS

Non-Final Office Action issued in corresponding U.S. Appl. No. 15/391,228 dated Jun. 26, 2019.
Final Office Action issued in corresponding U.S. Appl. No. 15/391,228 dated Oct. 2, 2018.
Non-Final Office Action issued in corresponding U.S. Appl. No. 15/391,228 dated Feb. 14, 2018.

* cited by examiner

METHOD OF MANUFACTURING A COIL ELECTRONIC COMPONENT

CROSS-REFERENCE TO RELATED APPLICATION(S)

This application is the Divisional Application of U.S. patent application Ser. No. 15/391,228 filed on Dec. 27, 2016, now abandoned, which claims benefit of priority to Korean Patent Application No. 10-2016-0046210 filed on Apr. 15, 2016 in the Korean Intellectual Property Office, the disclosures of which are incorporated herein by reference in their entirety.

BACKGROUND

1. Field

The present disclosure relates to a coil electronic component and a manufacturing method thereof.

2. Description of Related Art

An inductor is an electronic component, and is a representative passive element used in electronic circuits together with resistors and capacitors to remove noise therefrom.

In parallel with recent developments in portable devices such as a smartphones, tablet personal computers (PC), and the like, the use of high-speed application processing units (APU) and large area displays has increased, such that required amounts of rated current may not be obtained with standard ferrite inductors.

To address the shortcomings in ferrite inductors, numerous metal composite inductors in which a metal powder having excellent DC-bias characteristics and an organic material are combined, or the like, have emerged, and thereamong, a winding type inductor is dominant.

Examples of such a winding type inductor include a rectangular wire winding type inductor, an edge-wise wire winding type inductor, a lead frame type inductor, a metal mold winding type inductor, and the like. However, these winding type inductors have a disadvantage in that productivity thereof may be low.

SUMMARY

An aspect of the present disclosure may provide a coil electronic component having excellent DC-bias characteristics by inserting a pillar-shaped core part into the coil electronic component. The disclosure further provides a method of manufacturing the coil electronic component using a magnetic sheet.

According to an aspect of the present disclosure, a coil electronic component may include a body and external electrodes. The body includes a winding coil part and a pillar-shaped core part inserted into a center of the winding coil part and formed of a magnetic metal. The external terminals are connected to the winding coil part and disposed on an external surface of the body. The body contains the magnetic metal and a resin, and the core part has magnetic permeability higher than that of a portion of the body disposed outside of the winding coil part.

According to another aspect of the present disclosure a method of manufacturing a coil electronic component may include punching a plurality of magnetic sheets to have holds extending therethrough, and stacking the punched magnetic sheets to form first, second, and third blocks each having a respective groove formed therein. A pillar-shaped core formed of a magnetic metal is inserted into a groove formed in the first block, and a second block having a through hole formed therein is stacked on the first block so that the pillar-shaped core is disposed to penetrate through the through hole. A winding coil is loaded around the pillar-shaped core, and the third block is stacked on the second block to form a multilayer body in which the winding coil is loaded so that the pillar-shaped core is positioned in a groove of the third block.

According to a further aspect of the present disclosure a method of manufacturing a coil electronic component may include forming a first block from a plurality of magnetic sheets stacked in a thickness direction and including a magnetic metal, the first block having a groove extending from an upper surface through a partial thickness thereof. A pillar-shaped core formed of the magnetic metal is inserted into the groove formed of the first block. A second block is formed from a plurality of magnetic sheets stacked in the thickness direction and comprising the magnetic metal, the second block having a through hole extending through a thickness thereof. The second block is stacked on the first block such that the pillar-shaped core extends through the through hole of the second block. A winding coil is disposed around the pillar-shaped core within the through-hole of the second block. A third block is formed from a plurality of magnetic sheets stacked in the thickness direction and comprising the magnetic metal, the third block having a groove extending from a lower surface through a partial thickness thereof. The third block is then stacked on the second block such that the pillar-shaped core extends into the groove of the third block.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Figure 1:
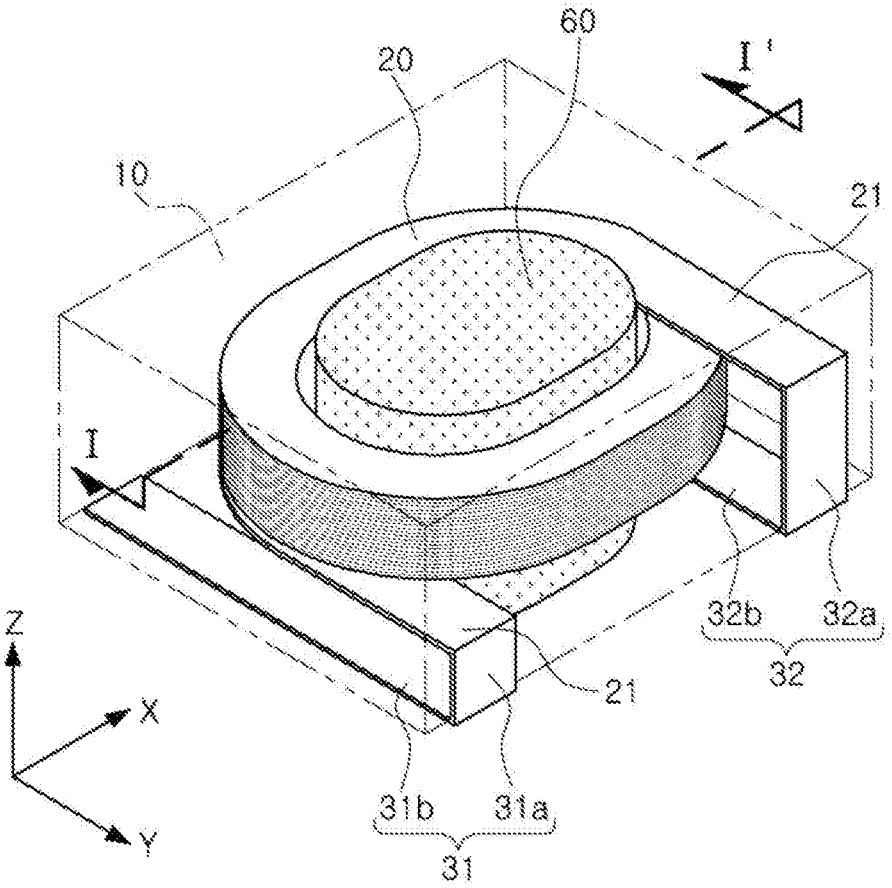
FIG. 1 is a schematic perspective view illustrating a coil electronic component according to an exemplary embodiment in which a coil, leads, a pillar-shaped core, and external terminals are visible.

FIG. 1 is a schematic perspective view illustrating a coil electronic component according to an exemplary embodiment in which a coil, leads, a pillar-shaped core, and external terminals are visible.

Figure 2:
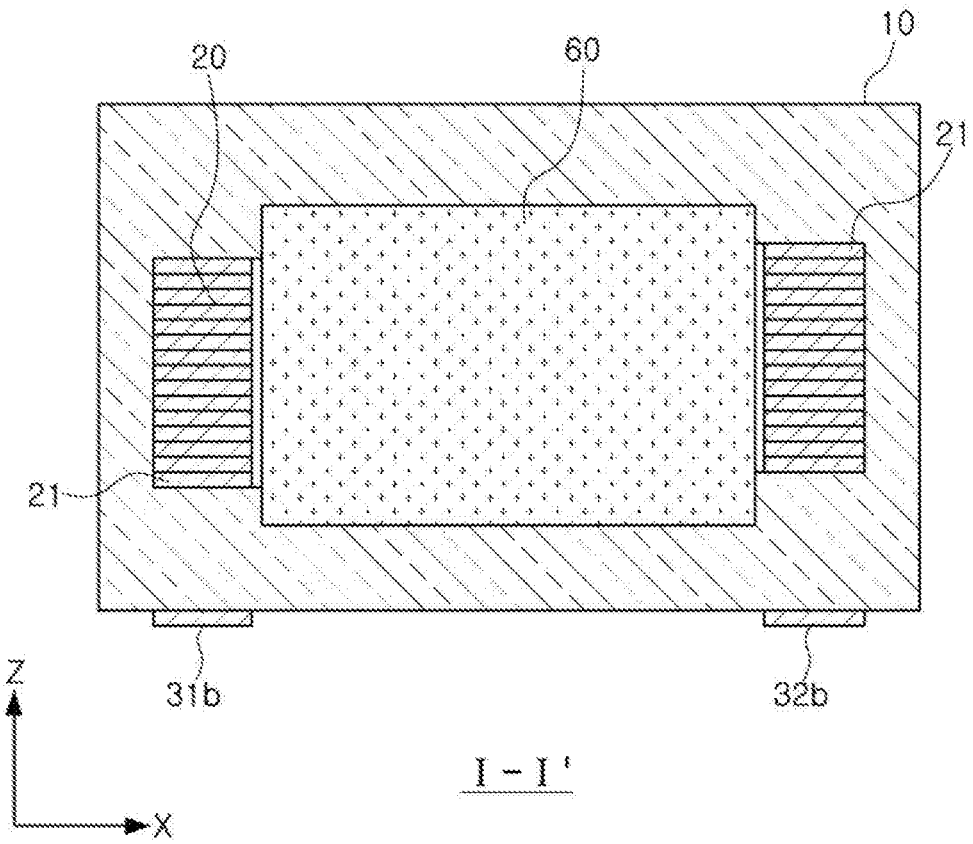
FIG. 2 is a cross-sectional view taken along line I-I' of FIG. 1.

FIG. 2 is a cross-sectional view taken along line I-I' of FIG. 1.

Referring to FIGS. 1 and 2, the coil electronic component according to the exemplary embodiment includes a body 10 in which a winding coil part 20 having leads 21 is disposed, and external terminals 31 and 32 connected to the winding coil part 20 through the leads 21 and disposed on an external surface of the body 10.

The body 10 may have a lower surface provided as amounting surface, an upper surface opposing the lower surface, end surfaces disposed opposite each other in a length direction, and side surfaces disposed opposite each other in a width direction.

A shape of the body 10 is not particularly limited. For example, the body 10 may have a hexahedral shape as shown in FIG. 1. Directions of a hexahedron, such as directions X, Y, and Z illustrated in FIG. 1, refer to a length direction, a width direction, and a thickness direction, respectively.

The body 10 may include a pillar-shaped core part 60 therein. The pillar-shaped core part 60 may be inserted into the center of the winding coil part 20 such that windings of the winding coil part 20 extend around an outer circumference of the core part 60.

The pillar-shaped core part 60 may be a pillar formed of a magnetic metal, and a cross-sectional shape thereof (e.g., a cross-sectional shape along the X-Y plane) may be a circle, an oval, or the like.

The pillar-shaped core part 60 may be formed by pressing a magnetic metal powder at high pressure.

In a general coil electronic component, since a core part is formed by stacking and pressing magnetic sheets on and below a coil part having a through hole to allow a magnetic material to be filled in the through hole, the core part contains the magnetic metal, a polymer resin, and the like.

That is, since a core part of a coil electronic component according to the related art is formed by pressing magnetic sheets containing a magnetic metal, a polymer resin, and a hardener, a density of the magnetic metal is low, such that there is a limitation in increasing magnetic permeability of the coil electronic component.

According to the exemplary embodiment presented herein, since the pillar-shaped core part 60 may be formed of only a magnetic metal and may formed at a high pressure, a density and magnetic permeability thereof may be high, such that high inductance may be obtained even with a small number of coil turns in the winding coil part 20.

In addition, since high inductance may be obtained even with a small number of turns, direct current resistance Rdc may also be decreased.

Meanwhile, according to the exemplary embodiment, the coil electronic component includes the winding coil part 20 having a winding structure, the body 10 containing the magnetic metal and the resin, and the pillar-shaped core part 60 formed of only the magnetic metal.

Therefore, the pillar-shaped core part 60 may have magnetic permeability higher than that of a portion outside the coil part 20, that is, a body 10 region disposed outside the coil part 20.

That is, the pillar-shaped core part 60 may only be formed of the magnetic metal but does not contain the polymer resin and the hardener, while the body 10 region disposed outside the coil part 20 may contain the magnetic metal and the resin. Therefore, the density of magnetic metal may be higher in the pillar-shaped core part 60 than in the portion of the body 10 disposed outside of the coil part 20.

Since the density of the magnetic metal is higher in the pillar-shaped core part 60 than in the portion outside the coil part 20, the pillar-shaped core part 60 may have magnetic permeability higher than that of the portion of the body 10 disposed outside of the coil part 20.

Further, upper and lower ends of the pillar-shaped core part 60 (e.g., ends of the pillar-shaped core part 60 extending above a top of the coil part 20 and below a bottom of the coil part 20) may contact a body region in which the density of the magnetic metal is low.

In the body 10, the pillar-shaped core part 60 may be inserted into the inner side of the winding coil part 20, and a magnetic region in which magnetic sheets are stacked may be disposed on upper and lower surfaces of the winding coil part 20 and of the pillar-shaped core part 60.

Since the magnetic region in which the magnetic sheets are stacked is disposed on the upper and lower surfaces of the winding coil part 20 and of the pillar-shaped core part 60, the magnetic region may contain a magnetic metal and a resin.

Therefore, the upper and lower ends of the pillar-shaped core part 60 formed of only the magnetic metal may contact a magnetic body region containing the magnetic metal and the resin.

Therefore, the upper and lower ends of the pillar-shaped core part 60 may contact the body region in which the density of the magnetic metal is low.

Further, the pillar-shaped core part 60 may have magnetic permeability higher than that of the body region contacting the upper and lower ends of the pillar-shaped core part 60.

That is, since the pillar-shaped core part 60 is formed of only the magnetic metal but does not contain the polymer resin and the hardener, and since the body 10 region contacting the upper and lower ends of the pillar-shaped core part 60 contains the magnetic metal and the resin, the density of the magnetic metal may be higher in the pillar-shaped core part 60 than in the body region contacting the upper and lower ends of the pillar-shaped core part 60.

Since the density of the magnetic metal is higher in the pillar-shaped core part 60 than in the body 10 region contacting the upper and lower ends of the pillar-shaped core part 60, the pillar-shaped core part 60 may have magnetic permeability that is higher than that of the body 10 region contacting the upper and lower ends of the pillar-shaped core part 60.

The density of the magnetic metal in the portion outside the winding coil part 20 may be equal to or less than 70% of the density of the magnetic metal in the pillar-shaped core part 60.

The pillar-shaped core part 60 may have higher magnetic permeability than the portion of the body 10 disposed outside the winding coil part 20 by adjusting the density of the magnetic metal in the portion outside the winding coil part 20 to be equal to or less than 70% of the density of the magnetic metal in the pillar-shaped core part 60, and thus the coil electronic component may exhibit high inductance even with a small number of turns or windings in the winding coil part 20.

In addition, since high inductance may be obtained even with a small number of turns, direct current resistance Rdc may also be decreased (e.g., since a conductor of a winding coil part 20 with fewer turns may have a shorter length, and hence a lower direct current resistance, than a conductor of a similar winding coil part having a higher number of turns).

In a case in which the density of the magnetic metal in the portion outside the winding coil part 20 is more than 70% of the density of the magnetic metal in the pillar-shaped core part 60, there may only be a small difference in the densities of the magnetic metal between the pillar-shaped core part 60 and the portion outside the winding coil part 20 such that an effect of increasing inductance may be small, and an effect of decreasing direct current resistance (Rdc) may also be small.

Meanwhile, when a current is applied to the winding coil part 20, a path (e.g., a magnetic path) through which a magnetic flux induced by current flow in the winding coil part 20 passes may be formed in the pillar-shaped core part 60.

The body 10 may be formed of magnetic metal particles and an insulating material contained between the magnetic metal particles. Here, the magnetic metal particles may be particles of a Fe—Cr—Si alloy, a Fe—Si—Al alloy, or the like, of which electrical resistance is high, magnetic force loss is low, and impedance may be easily designed by changing a composition. Further, as an insulating material which is thermally variable, an epoxy resin, a phenol resin, polyester, or the like, may be used.

The winding coil part 20 may include a spiral portion wound with a predetermined number of turns and the leads 21, wherein the leads 21 may be led from both opposing ends of the winding coil part 20, may be exposed to one surface of the body 10, and may have portions exposed on the one surface.

In more detail, the leads 21 may be exposed to a side surface of the body 10 in the width direction, and the exposed portions thereof may become the external electrodes 31 and 32 through a subsequent folding process.

The winding coil part 20 may be formed of a metal wire formed of copper (Cu), silver (Ag), or the like.

The winding coil part 20 may be formed of an edge-wise rectangular wire (e.g., a wire having a rectangular cross-section), but is not necessarily limited thereto.

Further, the winding coil part 20 is not limited to being formed of a single wire, but may also be formed of a stranded wire or two or more wires. In addition, a cross-sectional shape of a metal wire of the winding coil part 20 is not limited to being circular, but the metal wire may also have a tetragonal cross-sectional shape.

As an example, the metal wire may be wound by an α-winding method in a flat wire coil form.

Referring to FIG. 2, a region around the winding coil part 20, which is the body 10, may be filled with the magnetic material, and both ends of the winding coil part 20 may be connected to external terminals 31 and 32, respectively.

As illustrated in FIG. 2, the winding coil part 20 may be positioned at the center of the body 10. Alternatively, the winding coil part 20 may be positioned at an upper or lower end of the body 10, if necessary in view of a design or a manufacturing process.

The external terminals 31 and 32 may have side surface portions 31*a* and 32*a* folded along a side surface of the body 10 in the width direction to extend toward the lower surface of the body 10, and lower surface portions 31*b* and 32*b* extending from the side surface portions 31*a* and 32*a* and folded along the lower surface of the body 10.

In some examples, the external terminals 31 and 32 may extend from the lower surface portions 31*b* and 32*b* to be folded from the lower surface of the body 10 to the other/opposing side surface of the body 10 in the width direction (e.g., along the side surface of the body 10 that is disposed opposite to the side surface having the side surface portions 31*a* and 32*a*).

The external terminals 31 and 32 may contain a metal such as Ag, Ag—Pd, Ni, Cu, or the like, and Ni plating layers and Sn plating layers may be selectively formed on surfaces of the external terminals 31 and 32.

According to the exemplary embodiment, the winding coil part 20 may be wound in parallel with the lower surface of the body 10.

FIGS. 3A through 3J are cross-sectional views illustrating respective steps of a process of manufacturing a coil electronic component according to another exemplary embodiment.

Referring to FIGS. 3A through 3J, a manufacturing method of a coil electronic component according to another exemplary embodiment may include: punching a plurality of magnetic sheets per layer, and stacking the punched magnetic sheets to prepare a plurality of blocks having a groove formed therein; preparing a winding coil; preparing a pillar-shaped core using a magnetic metal; inserting the pillar-shaped core into the groove formed in a first block among the plurality of blocks; stacking a second block having a through hole formed therein among the plurality of blocks on the first block so that the pillar-shaped core is disposed to penetrate through the through hole; loading the winding coil around the pillar-shaped core; and preparing a multi-layer body by stacking a third block on the second block in which the winding coil is loaded so that the pillar-shaped core is positioned in a groove of the third block among the plurality of blocks.

Hereinafter, the manufacturing method of a coil electronic component according to another exemplary embodiment will be described in detail based on the accompanying drawings.

1. Process of Punching Plurality of Magnetic Sheets Per Layer

Figure 3A:
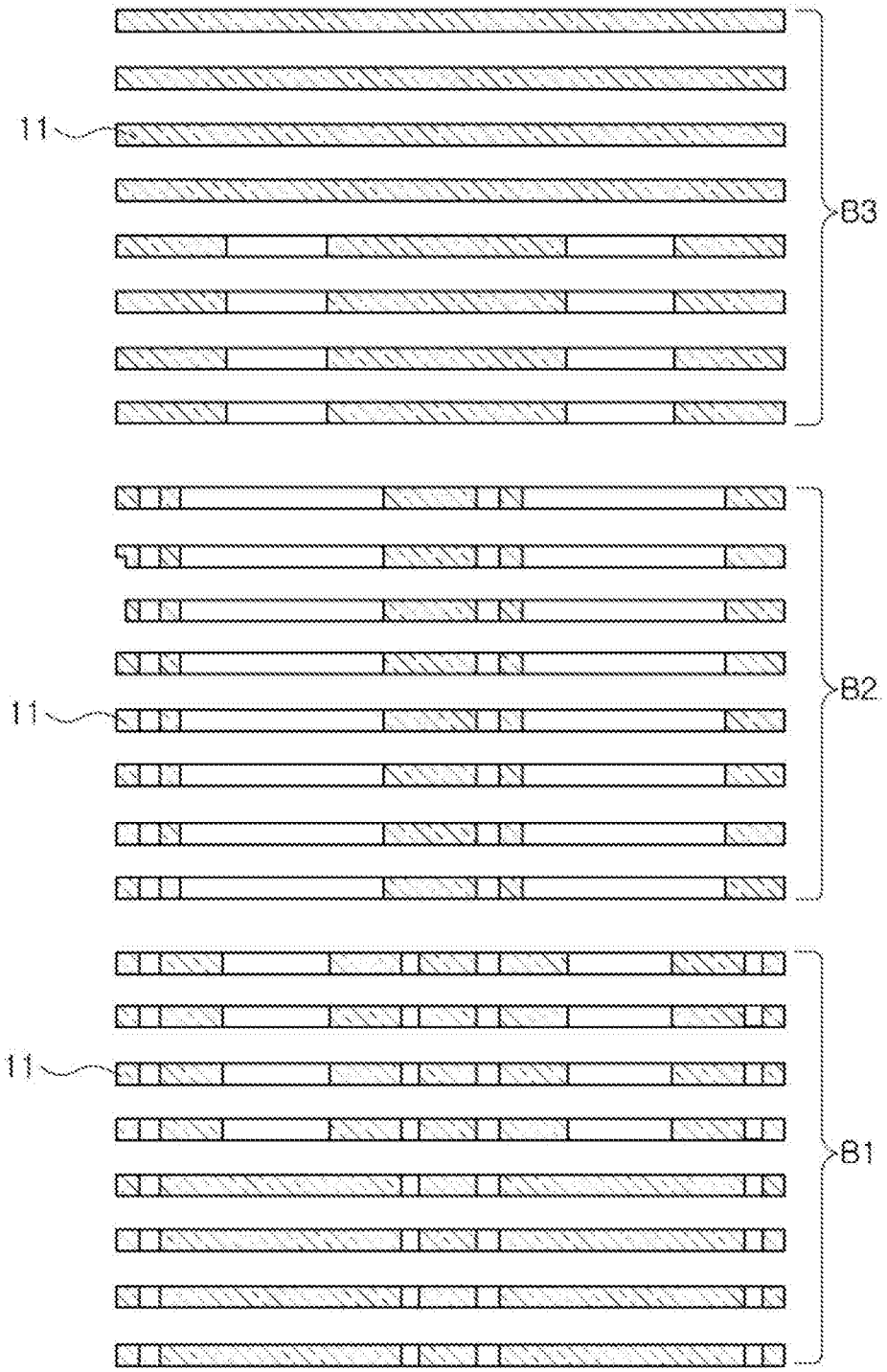
FIGS. 3A through 3J are cross-sectional views illustrating respective sequential steps of a process for manufacturing a coil electronic component according to another exemplary embodiment.
Figure 3B:
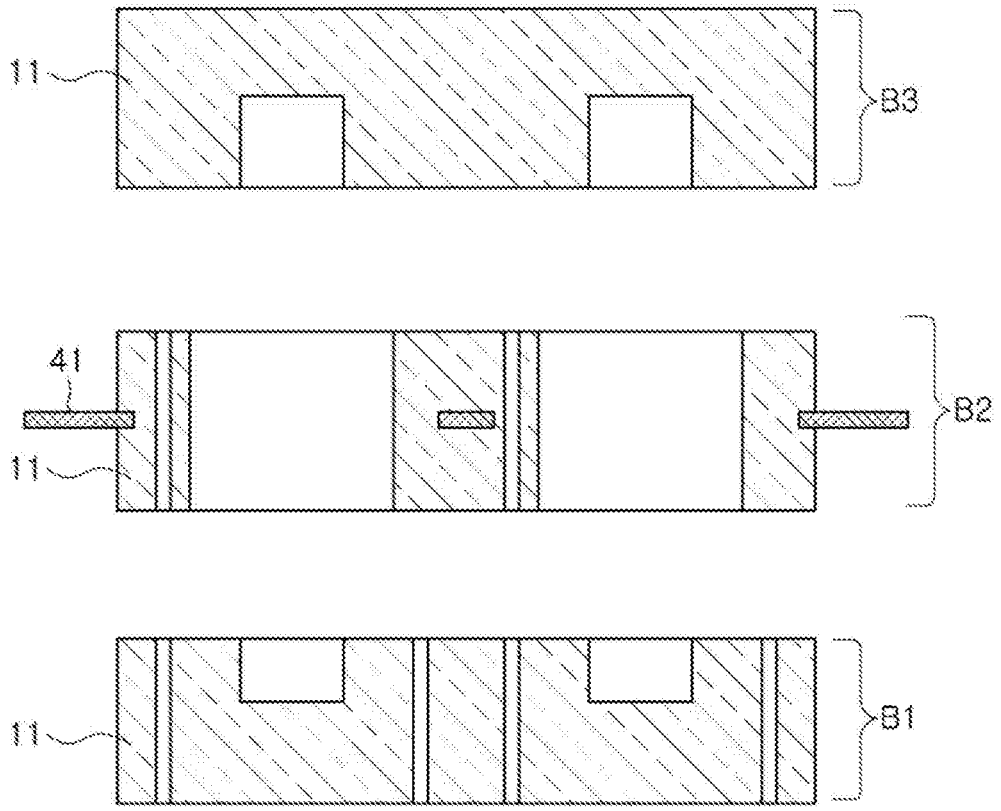

Referring to FIG. 3A, before stacking a plurality of magnetic sheets 11, each magnetic sheet 11 is punched per layer.

The plurality of magnetic sheets 11 may be manufactured in a sheet shape by mixing a metal magnetic powder and organic materials such as a thermosetting resin, a binder, a solvent, and the like, with each other to prepare slurry, applying the slurry to a carrier film at a thickness of several tens of microns (μm) by a doctor blade method, and then drying the applied slurry.

The magnetic sheet 11 may be manufactured in a form in which the metal magnetic powder is dispersed in a thermosetting resin such as an epoxy resin, polyimide, or the like.

The metal magnetic powder may be formed of a metal or alloy including any one or more selected from the group consisting of iron (Fe), silicon (Si), boron (B), chromium (Cr), aluminum (Al), copper (Cu), niobium (Nb), and nickel (Ni), and may be a crystalline or amorphous metal powder.

For example, the metal magnetic powder may be a Fe—Si—Cr based amorphous metal powder, but is not necessarily limited thereto.

The process of punching the respective magnetic sheets 11 per layer is used to form grooves so that the pillar-shaped core can be inserted thereinto, the winding coil can be loaded therein, and a lead of the winding coil can be exposed to an external surface of the body in processes to be described below.

2. Process of Stacking Punched Magnetic Sheets to Prepare Plurality of Blocks Having Groove Formed Therein Referring to FIGS. 3A and 3B, a plurality of blocks B1, B2, and B3 in which a groove is formed may be prepared by stacking the punched magnetic sheets.

Among the plurality of blocks, a first block B1 may be manufactured by stacking lower magnetic sheets 11 among the magnetic sheets 11, and the groove into which a pillar-shaped core to be described below is inserted may be formed therein.

Among the plurality of blocks, a second block B2 may be manufactured by stacking intermediate magnetic sheets 11 among the magnetic sheets 11, and may be a block stacked on the first block B1 after the pillar-shaped core is inserted into the groove of the first block B1. A metal frame 41 may be inserted into a central portion of the second block B2 in a thickness direction.

Among the plurality of blocks, a third block B3 may be manufactured by stacking upper magnetic sheets 11 among the magnetic sheets 11, and may be a block stacked on the second block B2.

In the present process, the plurality of blocks may be manufactured by stacking the magnetic sheets in a low pressure state, and the plurality of blocks may be in a temporarily stacked state.

3. Process of Preparing Winding Coil

Figure 3C:
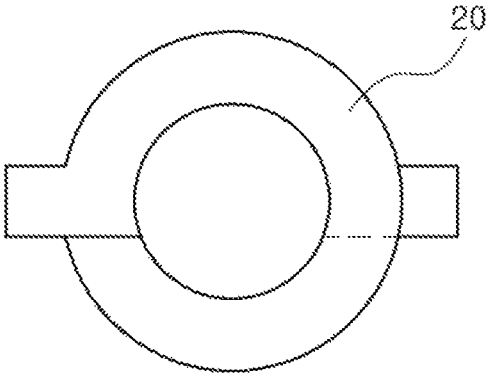

Referring to FIG. 3C, the winding coil 20 may be prepared.

The winding coil 20 may be a winding coil formed by a winding method.

The winding coil 20 may be formed of a metal wire formed of copper (Cu), silver (Ag), or the like.

The winding coil 20 may be formed of an edge-wise rectangular wire, but is not necessarily limited thereto.

Further, the winding coil 20 is not limited to a single wire, but may also be formed of a stranded wire or two or more wires. In addition, a cross-sectional shape of a metal wire of the winding coil part 20 is not limited to a circle, but the metal wire may also have a tetragonal cross-sectional shape.

4. Process of Preparing Pillar-Shaped Core Using Magnetic Metal

Figure 3D:
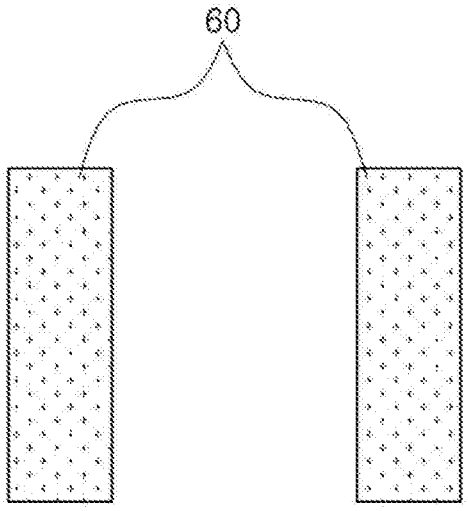
Figure 3E:
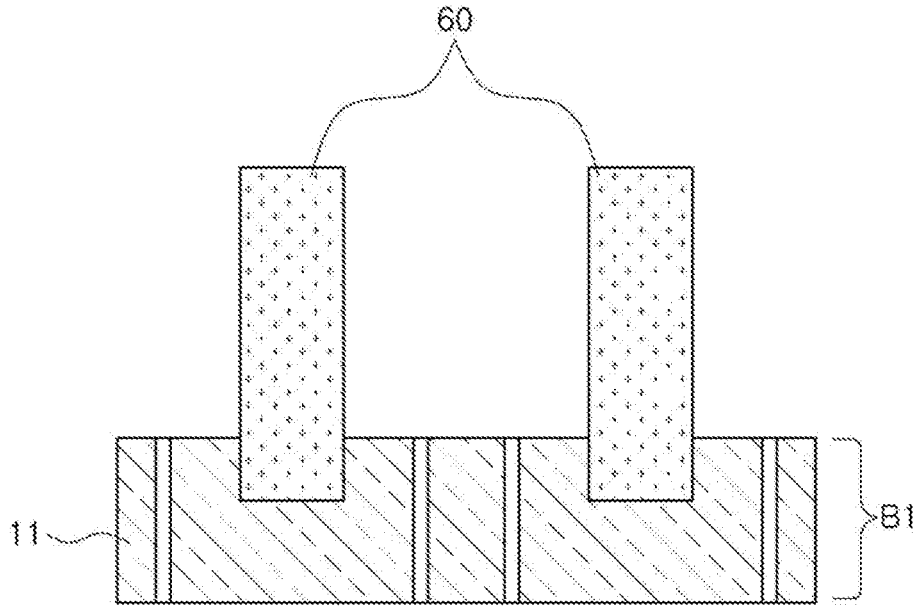
Figure 3F:
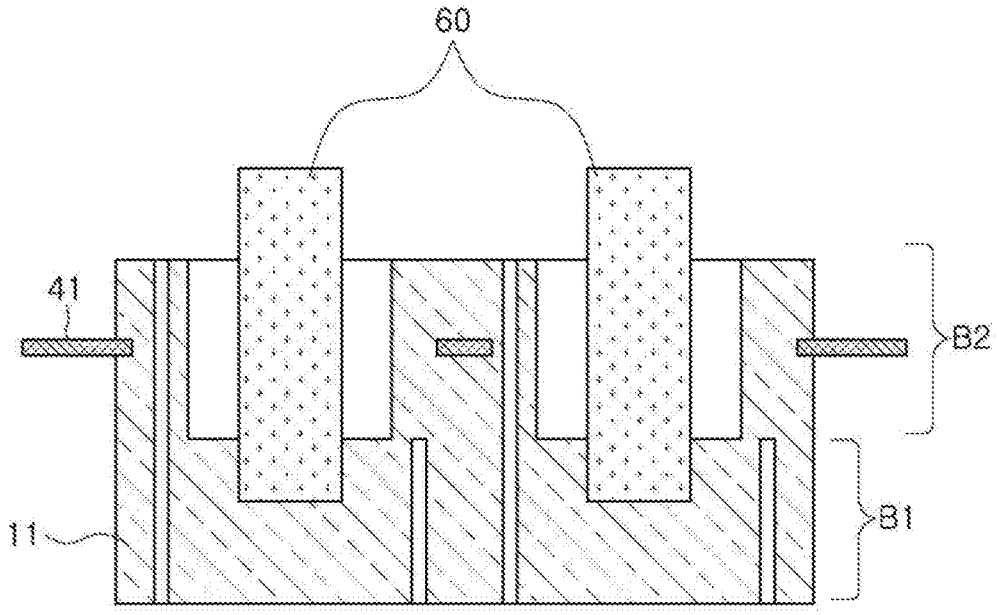

Referring to FIG. 3D, a pillar-shaped core 60 may be prepared using the magnetic metal.

The pillar-shaped core 60 may be a pillar formed of the magnetic metal, and a cross-sectional shape thereof may be a circle, an oval, or the like.

The pillar-shaped core 60 may be formed by pressing a magnetic metal powder with high pressure.

In a general coil electronic component, since a core part is formed by stacking and pressing magnetic sheets on a coil part having a through hole to allow a magnetic material to be filled in the through hole, the core part contains a magnetic metal, a polymer resin, and the like.

That is, since a core part of a coil electronic component according to the related art is formed by pressing magnetic sheets containing a magnetic metal, a polymer resin, and a hardener, a density of the magnetic metal is low, such that there is a limitation in increasing magnetic permeability of the coil electronic component.

According to the exemplary embodiment described herein, since the pillar-shaped core 60 can be formed of only the magnetic metal, and formed at a high pressure, a density and magnetic permeability thereof may be high, such that high inductance may be obtained even with a small number of coil turns.

In addition, since high inductance may be obtained even with a small number of turns, direct current resistance Rdc may also be decreased.

5. Process of Inserting Pillar-Shaped Core into Groove Formed in First Block Among Plurality of Blocks Referring to FIG. 3E, among the plurality of blocks, the first block B1 may be manufactured by stacking the lower magnetic sheets 11 among the magnetic sheets 11, and the groove into which the pillar-shaped core 60 is inserted may be formed therein.

The pillar-shaped core 60 may be inserted into the groove formed in the first block B1 among the plurality of blocks.

6. Process of Stacking Second Block Having Through Hole Formed Therein Among Plurality of Blocks on First Block So That Pillar-shaped Core is Disposed to Penetrate Through Hole Referring to FIG. 3F, among the plurality of blocks, the second block B2 may be manufactured by stacking the intermediate magnetic sheets 11 among the magnetic sheets 11, and may have a structure in which the through hole is formed, and the metal frame 41 may be inserted into the central portion of the second block B2 in the thickness direction.

The second block B2 may be stacked on the first block B1 into which the pillar-shaped core 60 is inserted so that the pillar-shaped core 60 is disposed to penetrate through the through hole.

7. Process of Loading Winding Coil Around Pillar-Shaped Core

Figure 3G:
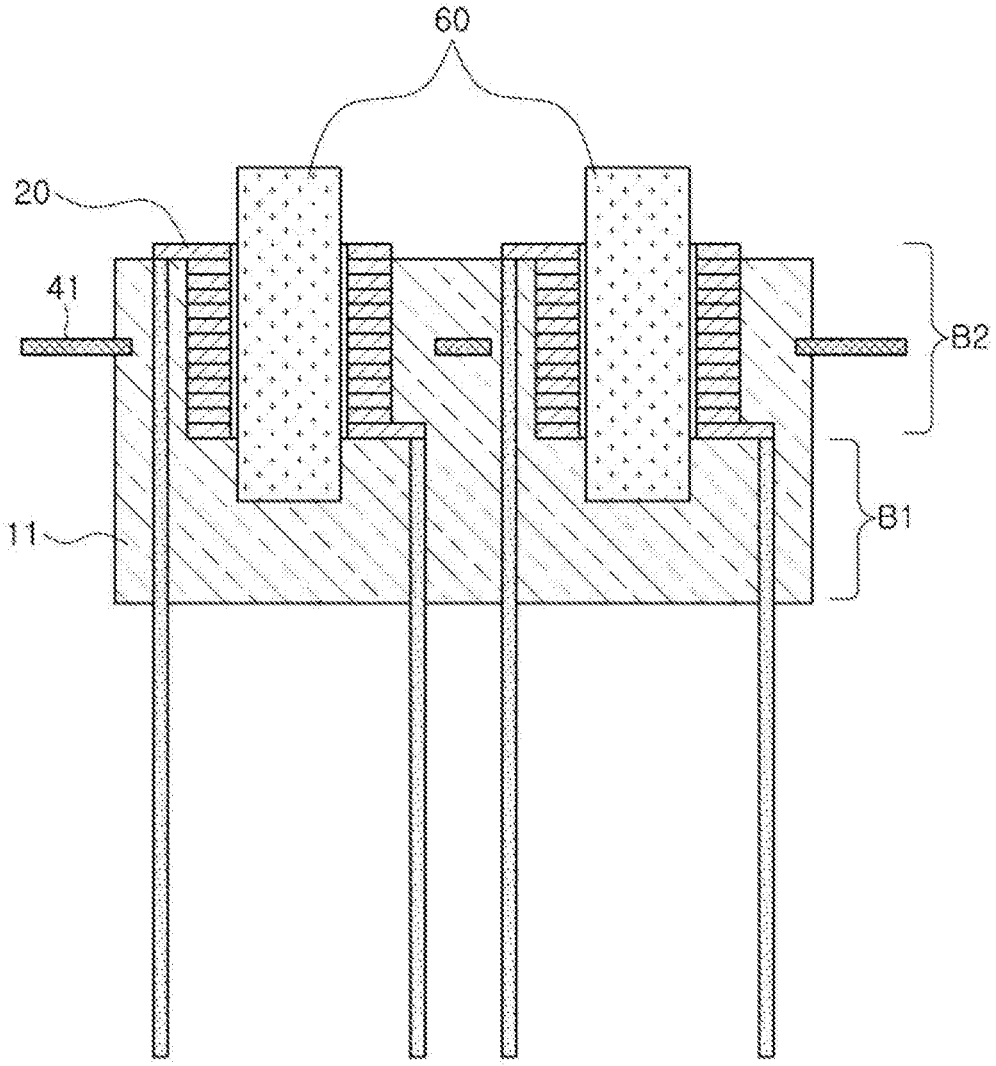
Figure 3H:
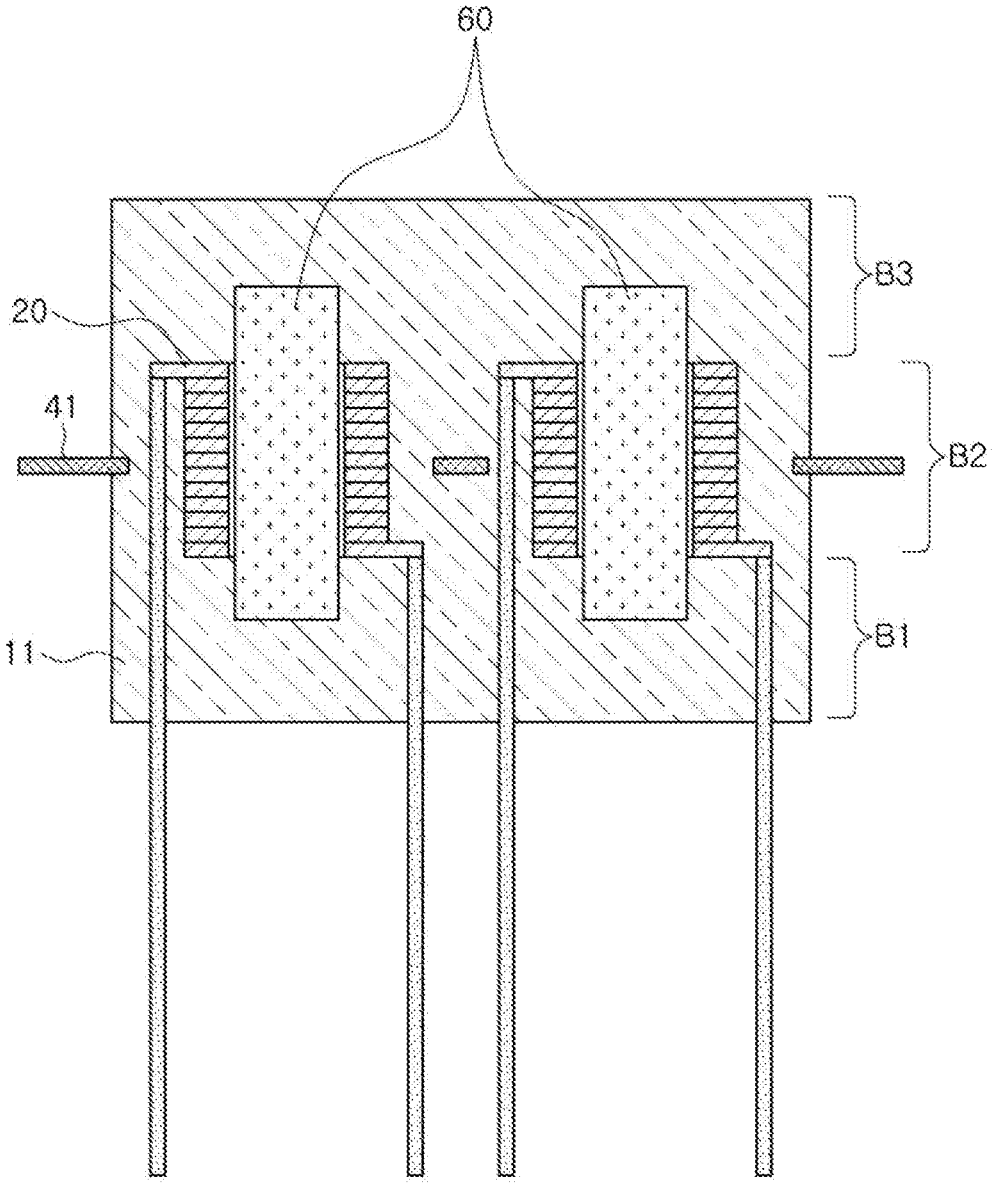

Referring to FIG. 3G, the winding coil 20 may be loaded around the pillar-shaped core 60.

The winding coil 20 may be loaded in a position of the through hole of the second block B2, and the leads of the coil may be exposed to the outside through a through hole formed in the first block B1.

8. Process of Preparing Multilayer Body by Stacking Third Block on Second Block in Which Winding Coil is Loaded So That Pillar-Shaped Core is Positioned in Groove of Third Block Among Plurality of Blocks Referring to FIG. 3H, the multilayer body may be prepared by stacking the third block B3 on the second block B2 in which the winding coil 20 is loaded so that the pillar-shaped core 60 is positioned in the groove of the third block B3 among the plurality of blocks.

Among the plurality of blocks, the third block B3 may be manufactured by stacking the upper magnetic sheets 11 among the plurality of magnetic sheets 11.

9. Process of Pressing Multilayer Body to Form Body

Figure 3I:
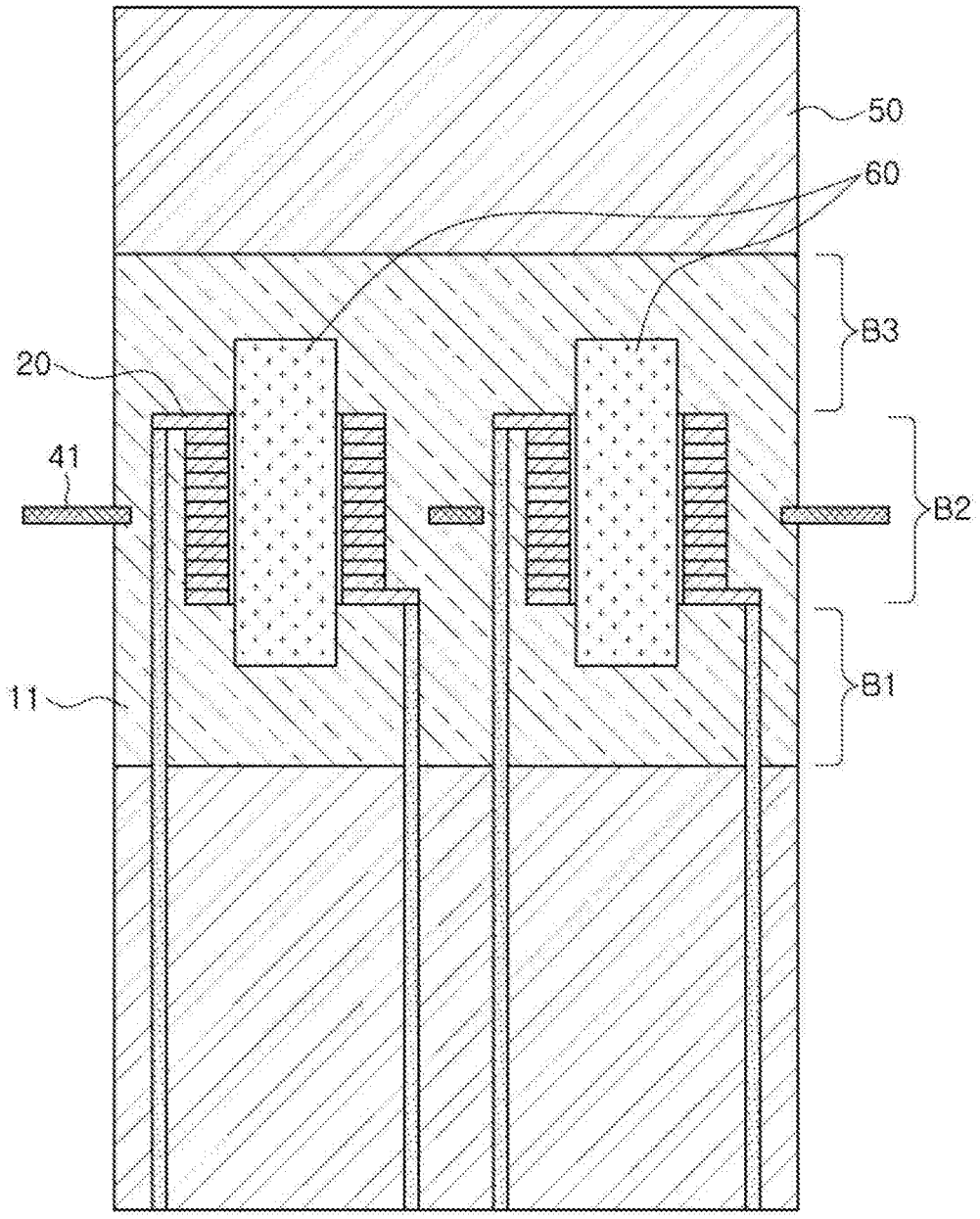

Referring to FIG. 3I, a body may be formed by pressing the multilayer body.

The multilayer body may be pressed by disposing an iron plate 50 on upper and lower portions of the multilayer body.

10. Process of Forming External Terminals on External Surface of Body

Figure 3J:
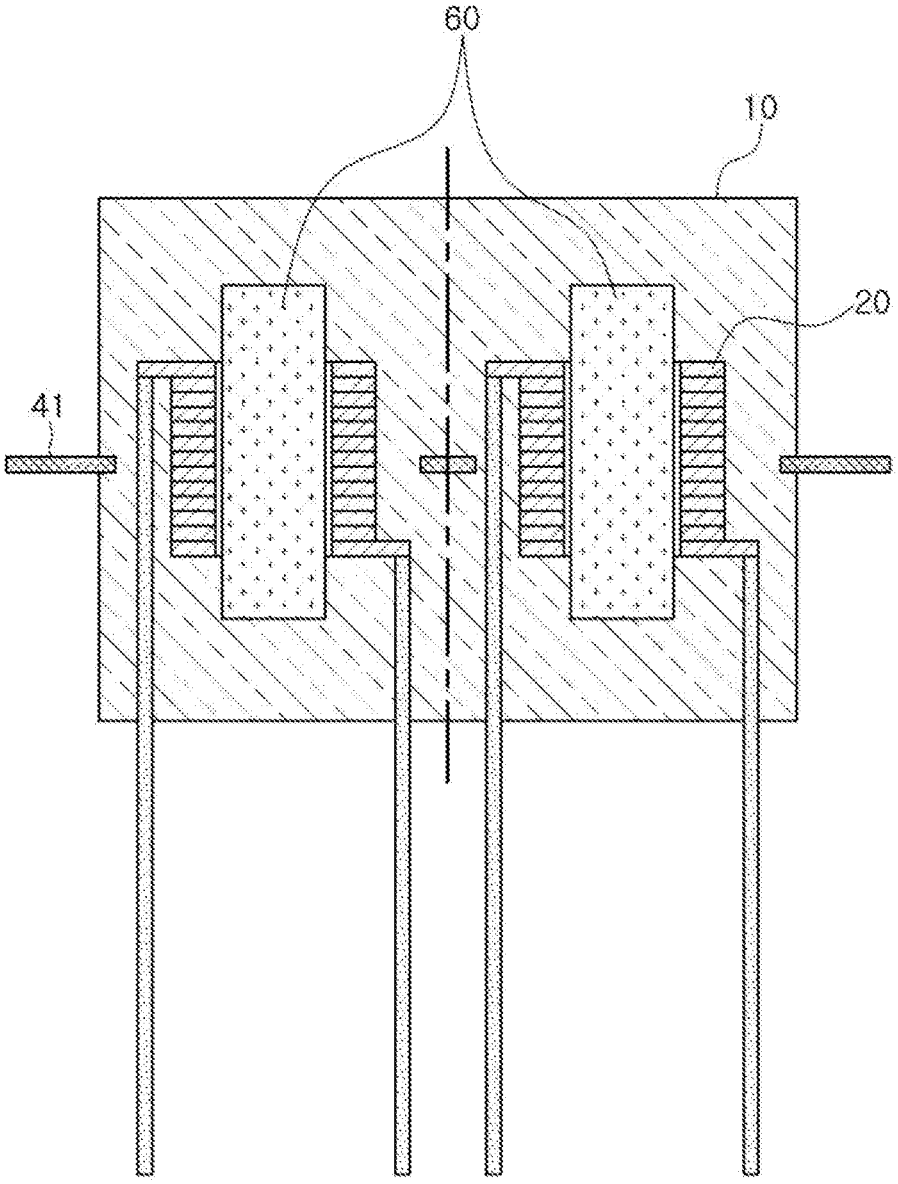

Referring to FIG. 3J, the iron plate 50 may be removed, and the multilayer body may be hardened at a temperature of 180° C. for about 1 hour, thereby manufacturing a hardened body 10.

A portion corresponding to the leads of the winding coil 20 may be exposed to a side surface of the body 10 in a width direction, and the external terminal may be formed on an external surface of the body 10 by folding the exposed portion.

The winding coil 20 may have the leads, wherein the leads may be exposed from both ends of the coil to one surface of the multilayer body, and include the exposed portion.

The external terminals may have a side surface portion folded from one side surface of the body 10 in the width direction toward a lower surface of the body 10, and a lower surface portion folded along the lower surface of the body 10.

The external terminals may be extended from the lower surface portion folded along the surface of the body 10 toward the other side surface of the body 10 in the width direction.

That is, the external terminals may be formed by folding the exposed portion of the leads of the winding coil 20 from the side surface of the body 10 in the width direction toward the lower surface of the body 10, and folding the exposed portion of the leads of the winding coil 20 along the lower surface of the body 10.

The lower surface of the body 10 may be amounting surface mounted on a substrate at the time of mounting the coil electronic component on the substrate.

Finally, a measuring process and a taping process may be additionally performed.

As set forth above, according to exemplary embodiments, the coil electronic component may be provided in which the pillar-shaped core part formed of the magnetic metal is disposed in a magnetic body containing the magnetic metal and the resin, such that the coil electronic component having excellent DC-bias characteristics may be implemented.

According to another exemplary embodiment, although the manufacturing method using the magnetic sheets is applied, since the pillar-shaped core is inserted into the body, and a process of separating each component after manufacturing the components in an array form is applied, a production amount per unit process may be increased, whereby productivity may be improved and costs may be decreased.

While exemplary embodiments have been shown and described above, it will be apparent to those skilled in the art that modifications and variations could be made without departing from the scope of the present invention as defined by the appended claims.

What is claimed is:

1. A method of manufacturing a coil electronic component, the method comprising:

punching a plurality of magnetic sheets, and stacking the punched magnetic sheets to form first, second, and third blocks having a first groove, a through hole, and a second groove, respectively, formed therein;

inserting a pillar-shaped core formed of a magnetic metal into the first groove formed in the first block;

stacking the second block on the first block so that the pillar-shaped core is disposed to penetrate through the through hole;

loading a winding coil around the pillar-shaped core; and stacking the third block on the second block to form a multilayer body in which the winding coil is loaded so that the pillar-shaped core is positioned in the second groove of the third block.

2. The method of claim 1, further comprising pressing the multilayer body to form a body.

3. The method of claim 2, wherein the pressing of the multilayer body to form the body is performed by disposing an iron plate on upper and lower portions of the multilayer body.

4. The method of claim 2, wherein the winding coil has leads, each lead extending from a respective end of the winding coil to one surface of the multilayer body and having an exposed portion.

5. The method of claim 4, wherein the leads are exposed to a side surface of the body in a width direction.

6. The method of claim 4, further comprising folding the exposed portions of the leads to form external terminals on an external surface of the body.

7. The method of claim 6, wherein the external terminals extend from a side surface of the body in a width direction to a lower surface of the body.

8. A method of manufacturing a coil electronic component, the method comprising:

forming a first block from a plurality of magnetic sheets stacked in a thickness direction and comprising a magnetic metal, the first block having a groove extending from an upper surface through a partial thickness thereof;

inserting a pillar-shaped core formed of the magnetic metal into the groove formed of the first block;

forming a second block from a plurality of magnetic sheets stacked in the thickness direction and comprising the magnetic metal, the second block having a through hole extending through a thickness thereof;

stacking the second block on the first block such that the pillar-shaped core extends through the through hole of the second block;

disposing a winding coil around the pillar-shaped core within the through-hole of the second block;

forming a third block from a plurality of magnetic sheets stacked in the thickness direction and comprising the magnetic metal, the third block having a groove extending from a lower surface through a partial thickness thereof; and stacking the third block on the second block such that the pillar-shaped core extends into the groove of the third block.

9. The method of claim 8, wherein the disposing the winding coil around the pillar-shaped core within the through-hole of the second block comprises disposing the winding coil to contact the upper surface of the first block at a location adjacent to the groove of the first block.

10. The method of claim 8, wherein the forming the first block further comprises forming the first block to have a through hole extending therethrough in the thickness direction, the method further comprising disposing a lead within the through hole of the first block to extend between an end of the winding coil and a lower surface of the first block.

11. The method of claim 10, wherein the forming the first and second blocks further comprise forming the first and second blocks to each have a second through hole extending therethrough in the thickness direction, the stacking the second block on the first block comprises stacking the second block on the first block such that the second through holes are aligned, the method further comprising disposing a second lead to extend within the second through holes of the first and second blocks between another end of the winding coil and a lower surface of the first block.

* * * * *